US008734611B2

(12) United States Patent
Sabourin et al.

(10) Patent No.: US 8,734,611 B2
(45) Date of Patent: May 27, 2014

(54) MEDIUM CONSISTENCY REFINING METHOD OF PULP AND SYSTEM

(75) Inventors: Marc Sabourin, Beavercreek, OH (US); Johann Aichinger, Pregarten (AT)

(73) Assignee: Andritz Inc., Glens Falls, NY (US)

( * ) Notice: Subject to any disclaimer, the term of this patent is extended or adjusted under 35 U.S.C. 154(b) by 468 days.

(21) Appl. No.: 12/388,669

(22) Filed: Feb. 19, 2009

(65) Prior Publication Data

US 2009/0288789 A1 Nov. 26, 2009

Related U.S. Application Data

(60) Provisional application No. 61/035,853, filed on Mar. 12, 2008.

(51) Int. Cl.
*D21B 1/26* (2006.01)
*D21B 1/12* (2006.01)
*D21B 1/14* (2006.01)

(52) U.S. Cl.
CPC .. *D21B 1/26* (2013.01); *D21B 1/12* (2013.01); *D21B 1/14* (2013.01)
USPC ..... 162/28

(58) Field of Classification Search
USPC ..... 162/24, 28
See application file for complete search history.

(56) References Cited

U.S. PATENT DOCUMENTS 3,989,588 A * 11/1976 Charters et al. ..... 162/234
4,244,779 A 1/1981 Nieminen et al.
4,311,670 A 1/1982 Nieminen et al.
4,971,519 A * 11/1990 Timperi et al. ..... 415/1
5,087,171 A 2/1992 Dosch et al.
5,106,456 A * 4/1992 Voitto et al. ..... 162/17
5,167,373 A * 12/1992 Bohn et al. ..... 241/28
5,168,373 A * 12/1992 Nakamura ..... 358/406
5,200,038 A * 4/1993 Brown ..... 162/261
5,209,641 A 5/1993 Hoglund et al.
5,540,392 A * 7/1996 Broderick et al. ..... 241/28
5,615,997 A 4/1997 Hoglund et al.
5,772,847 A 6/1998 Simpson et al.
5,776,305 A 7/1998 Sabourin
5,879,510 A * 3/1999 Hagglund et al. ..... 162/25
6,364,998 B1 4/2002 Sabourin
7,300,541 B2 11/2007 Sabourin (Continued)

FOREIGN PATENT DOCUMENTS

EP 1 584 743 10/2005
EP 1 728 917 12/2006

(Continued)

OTHER PUBLICATIONS

Gullichsen et al., Chemical Pulping 6A, 1999, Fapet Oy,p. A616-A624.*

(Continued)

*Primary Examiner* — Anthony Calandra
(74) *Attorney, Agent, or Firm* — Nixon & Vanderhye P.C.

(57) ABSTRACT

A thermomechanical pulping method including: refining pulp with a high consistency refining stage, and a medium consistency refining stage processing the refined pulp discharge from the high consistency refining stage. Chemical pretreatments for improving pulp quality development during medium consistency refining can be optionally added at the pressurized chip press, fiberizer pre-refining step, primary high consistency refining step, and/or the standpipe feeding the medium consistency refiner.

12 Claims, 9 Drawing Sheets

(56) References Cited

U.S. PATENT DOCUMENTS

| | | | | |
|---|---|---|---|---|
| 2001/0050151 | A1 | 12/2001 | Sabourin | |
| 2004/0118529 | A1* | 6/2004 | Kamijo et al. | 162/25 |
| 2005/0011622 | A1 | 1/2005 | Sabourin | |
| 2006/0006264 | A1 | 1/2006 | Sabourin et al. | |
| 2007/0119557 | A1 | 5/2007 | Munster | |
| 2007/0272778 | A1 | 11/2007 | Sabourin et al. | |
| 2008/0035286 | A1 | 2/2008 | Aichinger et al. | |

FOREIGN PATENT DOCUMENTS

| | | |
|---|---|---|
| JP | 09-501991 | 2/1997 |
| WO | 95/06158 | 3/1995 |
| WO | 96/41914 | 12/1996 |
| WO | 2004/009900 | 1/2004 |
| WO | 2005/005716 | 1/2005 |

OTHER PUBLICATIONS

Andritz, Andritz Medium Consistency Pumps SF series, 2007, downloaded online Apr. 4, 2012, downloaded from pdf.directindustry.com.*

"Low Consistency Refining of TMP: Who Says TMP Requires Only High Consistency Refiners? A Careful Evaluation of LCR Options May Change Your Mind—and Your Process", 7 pages, 2008.

"Pulp & Paper Canada", Pulpandpapercanada.com—Pulp & Paper Canada, printed Feb. 1, 2008, pp. 1-5, Jul. 1999.

"Basic Pulp Properties", 14 pages.

European Search Report for EP Application No. 09 15 4978 completed Jun. 16, 2009.

Hajime Kawahara, Final notice of Reason for Rejection, Japanese Patent Application 2009-059126, corresponding to U.S. Appl. No. 12/388,669, Jan. 25, 2013, pp. 1-3, Japan.

* cited by examiner

Tensile index versus Freeness – MCR, LCR, and HCR

Freeness versus Specific Energy Consumption – MCR, LCR, and HCR

Tensile index versus Freeness – comparison of refiner plates

Tensile index versus Freeness – effect of refining intensity

Tear index versus Tensile index – effect of refining intensity

FTensile index versus Specific Energy – effect of bisulfite treatment

Tensile Index vs. Freeness - Chemically Treated Hardwood

MEDIUM CONSISTENCY REFINING METHOD OF PULP AND SYSTEM

CROSS RELATED APPLICATION

This application claims the benefit of U.S. Provisional Patent Application 61/035,853, filed Mar. 12, 2008, the entirety of which is incorporated by reference.

BACKGROUND OF THE INVENTION

The invention relates to refining of lignocellulosic fibrous material and particularly to thermomechanical pulping (TMP) and other mechanical refining processes.

TMP processes have conventionally refined fibrous material at high consistencies, typically having consistencies of 20 percent (20%) or more fiber by weight of the pulp suspension passing through the refiner. At high consistency levels, the pulp suspension is a fibrous mass and is transported by a pressurized blowline or screw conveyor which can handle such masses. In contrast, pulp suspensions at lower consistency levels flow as a liquid slurry that can be moved by pumps.

Mechanically refining pulp at a high consistency requires a large amount of energy that is expended primarily in frictional heat losses associated with viscoelastic deformations of the pulp in the refining zone. These frictional heat losses result in a large amount of energy that is not applied directly to refining pulp. Refining pulp is the separation (defibrate) and development (fibrillate) of the wood fibers. Typically less than 10% to 15% of the electric energy applied in a high consistency TMP refiner is directly applied to refining the pulp. There is a long felt need to increase the energy efficiency of a TMP refiner.

To address the need for lower electric energy consumption, TMP mills are searching for ways of displacing energy-intensive high consistency refining (HCR) with less energy intensive refining processes. Over the last ten to fifteen years many TMP mills have installed a single low consistency refining (LCR) stage directly following a mainline high consistency refining (HCR) stage. In most of these mill applications, the low consistency refiner (LCR) applies a specific energy less than 150 kWh/ODMT (kilowatt hours per oven dried metric ton) and displaces less than 100 ml (milliliters) of freeness.

Because low consistency refiners apply energy to a fluid pulp slurry, they tend to operate at significantly higher refining intensities than do high consistency refiners. However, the high refining intensities and fluid medium limits the total energy that can be applied in the refining zone of a LCR. Further, low consistency refining tends to produce pulp having limited freeness reduction. The limited displacement of freeness arises from excessive shearing of fibers and loss in pulp strength due to a narrow plate gap and a high energy load in a single stage of low consistency refining. Multiple stages of low consistency refining have been proposed. However, there is a practical limit to the number of LCR stages due to the inherent shearing of less developed (high freeness) mechanical pulp fibers in low consistency refiners.

Entailing fiber pretreatments to increase fiber flexibility and resistance to shearing resulted in a displacement of approximately 400 mL of high consistency refining with multiple stages of low consistency refining and energy savings of more than 30% as compared to conventionally produced thermomechanical (TMP) pulps. These entailing pretreatment methods included partial wood fiber defibration in a pressurized chip press (such as described in U.S. Pat. No. 6,899,791) followed by gentle fiber separation in a high consistency refiner (such as described in U.S. Pat. No. 7,300,541), chemical treatment, and high-pressure/high-intensity primary refining (such as described in U.S. Pat. No. 5,776,305, and U.S. Pat. No. 6,165,317). These pretreatments help improve fiber development and minimize fiber damage when low consistency refining across such a large span of freeness.

Despite continued advances in thermomechanical pulping there remain several long felt needs including: i) improving pulp quality development; ii) developing less-energy intensive pump-through refiners, and iii) reducing the complexity and cost of mechanical equipment in TMP systems.

BRIEF DESCRIPTION OF THE INVENTION

A novel TMP process has been developed having an initial HCR stage and at least one subsequent medium consistency refining (MCR) stage. The MCR stage(s) processes a thick stock pulp slurry of wood chips, pre-conditioned cellulosic fibers, or other comminuted cellulosic material, having a pulp consistency in a range of 5% to 14% consistency. In contrast, LCR stages conventionally process a liquid pulp slurry having a consistency of typically below 5%. The use of a MCR stage(s) increases the pulping capacity of the refining process and reduces the number of refiners, as compared to a similar conventional TMP process with LCR stages. For example, a medium consistency (MC) refiner processing pulp having a consistency of 8% may replace two equally sized low consistency (LC) refiners processing pulp having a consistency of 4%.

The novel TMP process with a MCR stage(s) reduces energy consumption by limiting high consistency refining (HCR), preferably to a single HCR stage, and shifting a large portion of the refining activity from the HCR stage to the medium consistency refining stage(s). In so doing, both the number of high consistency refiners and pump-through refiners are preferably reduced, as compared to conventional TMP processes having HCR and several LCR stages. Further, a MCR stage(s) provides enhanced pulp quality development as compared to conventional TMP processes having HCR and LCR stages. The combined HCR and MCR stages produce pulp having high quality, such as pulp having high tensile strength, especially at low freeness levels.

The novel TMP process disclosed here includes a first HCR step, preferably with preconditioning treatments to enhance fiber development prior to medium consistency refining, and at least one subsequent MCR stage. An MC pump-through refiner may be configured to process twice the amount of pulp processed by a same sized conventional LC refiner. MC refiners may be used to reduce the total number of refining stages in a mill operation. The preconditioning step should improve the MC refining response at higher freeness levels, and increase displacement of energy-intensive HCR. The TMP pretreatments may include partial defibration in a pressurized chip press, gentle fiber separation in a fiberizer refiner, chemical treatments (before, during, or after the HC refining stage), high-intensity or high-pressure HC refining, and a combination of these processes.

A thermomechanical pulping method has been developed including: refining pulp with a high consistency refining stage, and a medium consistency refining (MCR) stage or multiple MCR stages processing the refined pulp discharge from the high consistency refining stage. The high consistency refining stage may include refining the pulp, such as wood chips, pre-conditioned wood fiber and comminuted cellulosic material, with a pressurized high consistency refiner. The method may further include diluting the refined pulp discharged by the high consistency refining stage in a standpipe and fluidizing the pulp in the standpipe. The medium consistency refining stage may include a mechanical disc refiner having plate segments with an open inlet.

A thermomechanical pulping method has been developed comprising: refining wood chips, pre-conditioned wood fibers or other comminuted cellulosic materials in a high consistency pulp suspension using a high consistency refining (HCR) stage, wherein the pulp suspension has a pulp consistency of at least twenty percent (20%) by weight of the suspension; diluting the suspension of refined pulp discharged from the HCR stage to a medium consistency having a pulp consistency in a range of 5% to 14% consistency by weight, and refining the refined pulp in the medium consistency suspension formed in the dilution step using a medium consistency refining (MCR) stage.

A thermomechanical pulping system has been developed comprising: a high consistency refining stage having an inlet receiving wood chips, pre-conditioned chips or fibrous material, or other comminuted cellulosic material, a refining zone, and an outlet discharging refined high consistency pulp; a pulp dilution stage have a first inlet to receive the refined high consistency pulp and a second inlet to receive a liquor, a chamber to dilute the refined high consistency pulp with the liquor to form medium consistency pulp, and an outlet discharging the medium consistency pulp, and a medium consistency refining stage having an inlet receiving the medium consistency pulp from the outlet of the pulp dilution stage, wherein the medium consistency refining stage includes a refining zone to refine the medium consistency pulp and an outlet for the refined medium consistency pulp.

DETAILED DESCRIPTION OF THE INVENTION

Figure 1:
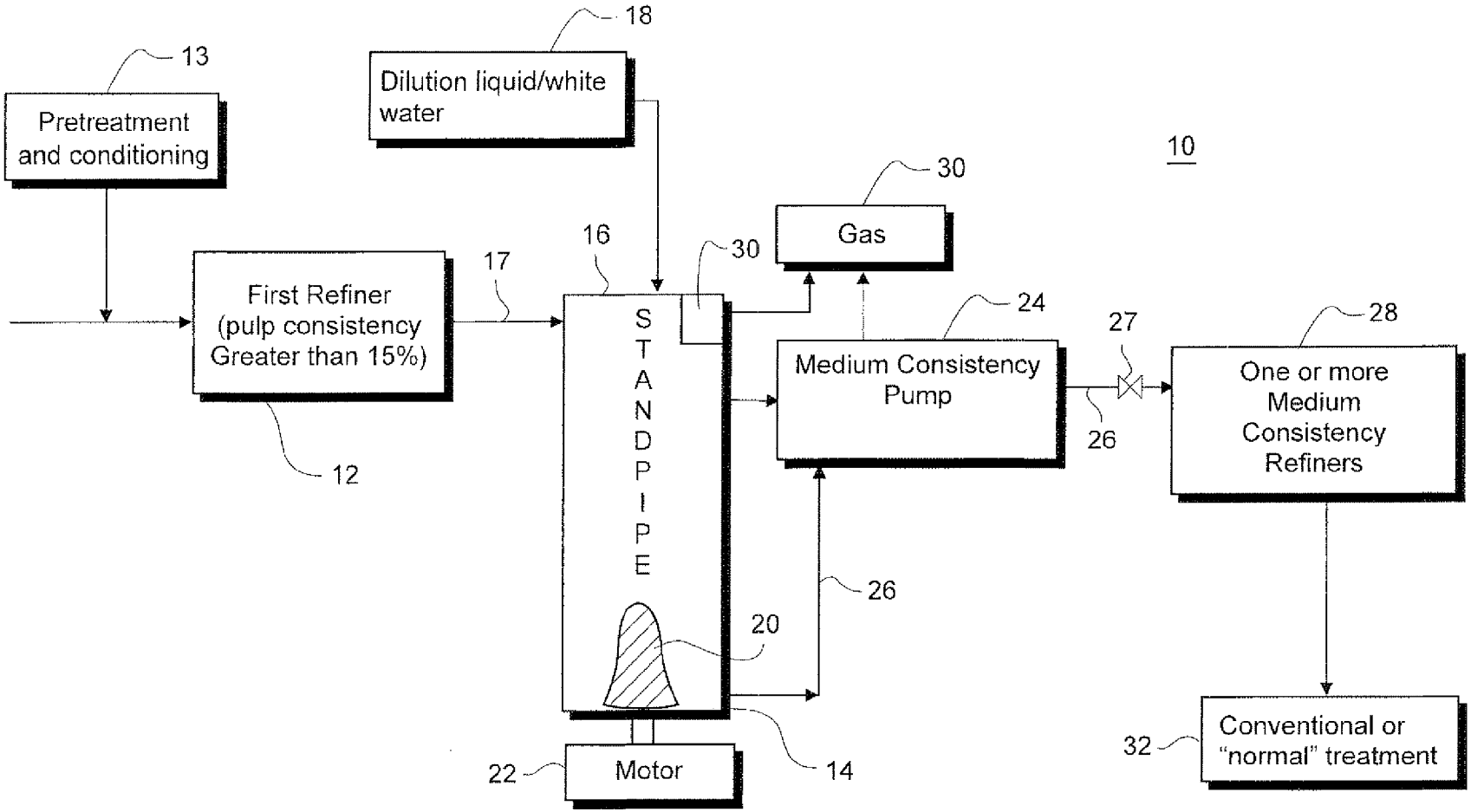
FIG. 1 is a mill process diagram of an exemplary refining system using high consistency and medium consistency refining stages.

FIG. 1 represents an exemplary mill operation 10 for processing comminuted cellulosic material 11, such as wood chips pre-conditioned wood fibers and destructured chips. The mill operation includes a conventional primary refiner stage 12 and a second refiner stage 28. The secondary refiner stage includes at least one medium consistency refiner. The primary stage refiner stage 12 may be a conventional high consistency pressurized refiner, such as a high speed pressurized refiner having opposing rotor and stator refiner discs that process wood chip, destructured chips, or other comminuted fiberized cellulosic material having a consistency of at least 20 percent (%) and preferably greater than 30%. The primary refining stage 12 may be associated with or without chemical pretreatment or conditioning 13, such as pretreatment and conditioning with alkaline, alkaline peroxide, and bio-agents, of lignocellulosic fibrous material, which may include hardwood, softwood, and non-wood cellulosic material such as grasses, kenaf, and bagasse, etc.

The partially refined pulp discharged from the primary refiner 12 flows to a standpipe 16. The partially refined pulp has a high consistency, such as greater than 20%. The high consistency pulp is either blown or conveyed, e.g., by a blowpipe or screw conveyor 17, to the standpipe 16 and diluted by the addition of liquor from a liquor source 18 of white water or other suitable liquor. The slurry in the standpipe is diluted to a medium consistency of 5% to 14%, preferably 5% to 12%, and most preferably 6% to 10%.

The standpipe 16 fluidizes the medium consistency pulp discharged from the primary refiner. Fluidization ensures that the pulp and liquid are well mixed at the discharge 14 of the standpipe. Without suitable fluidization, the pulp may separate from the liquor in the standpipe, and settle at the bottom and sides of the standpipe.

The pulp in the bottom of the standpipe may be fluidized with a conditioner 20, such as a rotating vertical screw, positioned at the bottom of the standpipe and turned by a motor 22. The conditioner 20 avoids excessive compaction of the fibrous pulp material in the bottom of the standpipe. The pressure of the pulp suspension in the standpipe creates a pressure head on the medium consistency pulp being discharged 14 from the standpipe.

A vacuum pump 21 degasses the pulp suspension in the standpipe, such that air 30 is removed from the pulp suspension through the inside of the conditioner 20 which is in contact with the pulp. Air removal promotes operation of the MC pump 24 in a stable condition at the desired pulp throughput. Air 30 may be removed from the pulp at other locations in the path 26 of the pulp suspension prior to the inlet to a medium consistency (MC) pump 24.

The medium consistency (MC) pump 24 may be a centrifugal pump having a sturdy shaft and multiple vane impeller. The MC pump 24 moves the medium consistency pulp from the stand pipe 16 to the medium consistency refiner 28. MC pumps are conventional, and tend to have a much heavier duty construction than do centrifugal-type pumps used for low consistency suspensions. MC pumps requires a larger motor, than the motors required to pump LC pulp suspension, due to the thick pulp suspension flowing from the standpipe.

The medium consistency, degassed pulp is pumped to the inlet of the MC refiner 28. An adjustable valve 27 regulates the rate of pulp suspension flowing through conduit 26 to the medium consistency (MC) refiner 28. The MC refiner 28 includes opposing discs defining between them a refining gap. The refiner may have a single rotating disc with a single refining zone or two or more rotating discs with multiple refining zones. The refined pulp discharged from the MC refiner 28 may flow to additional MC refiners, to a storage tank or to further conventional pulp processes 32, such as screening, cleaning or bleaching.

Figures 2A, 2B:
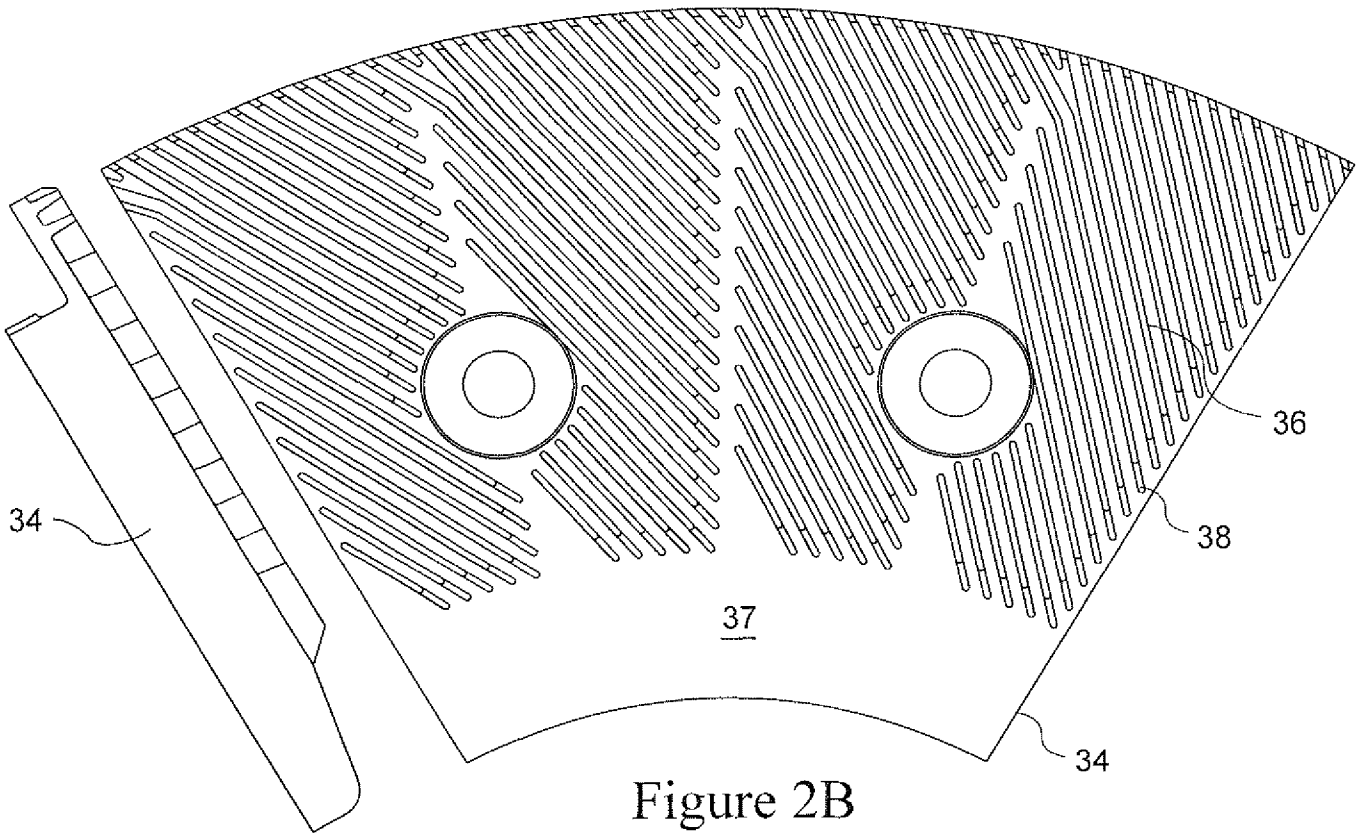
Figure 2B (Prior Art)
Figure 2A (Prior Art)
FIGS. 2A and 2B are a side view and front view, respectively, of a conventional refiner plate used for operation of a pump-through refiner at medium consistency.

FIGS. 2A and 2B are side and front views of a refiner plate segment 34. Plate segments 34 are mounted on opposing discs in the MC refiner. The rotation of at least one of the discs in the MC refiner applies centrifugal force to the pulp to move the pulp radially outward through the gap and over refining surfaces on the plate segments. These surfaces may include bars 36 and grooves 38 that apply energy in the form of compressive forces to develop the pulp fibers. Preferably, the refining plates 34 have a large open inlet 37 which is suitable and open enough to allow stable feeding of the medium consistency pulp. The refiner plate segment 34 is suitable for medium consistency refining with the open inlet 37 for feeding the pulp and a high number fine bars 36 to increase pulp strength development (increase forces applied by bars) in the refining gap. A wide range of plate segment designs may be used for refining pulps at medium consistency levels. Sufficient open area should be available within the plate grooves 38 to allow higher amounts of pulp to radially pass through the refiner while achieving a satisfactory number of bar treatments for good pulp quality development. For example, the width of the grooves may be approximately twice the width of the bars and one-half the height of the bars. By way of example, the groove width may be 2.79 mm, the bar width 1.50 mm and the bar height 7.01 mm.

Figure 3:
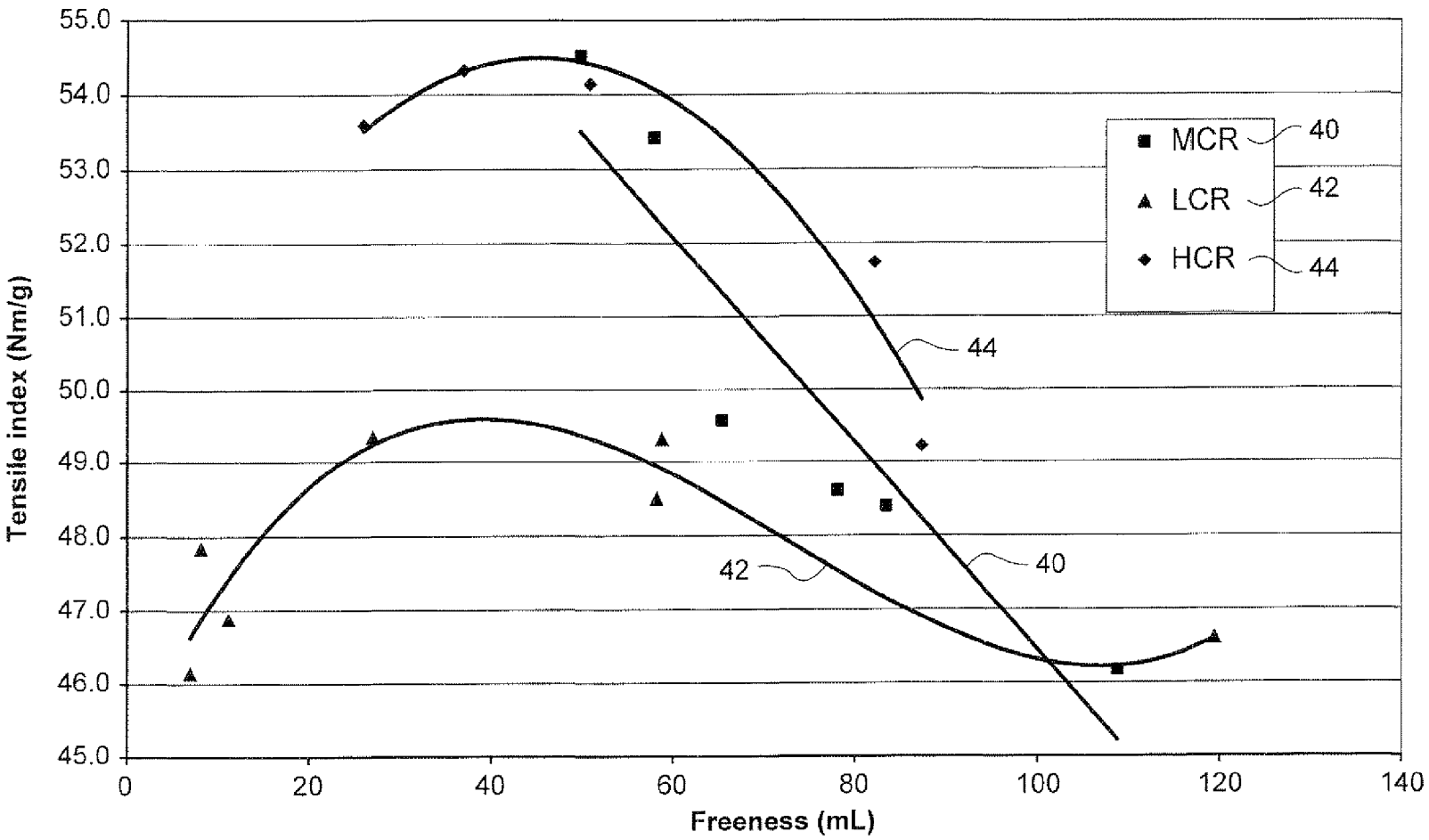
FIG. 3 is a chart showing fiber tensile index versus pulp freeness for softwood fibers treated by medium consistency (MC), low consistency (LC) and high consistency (HC) refining techniques.

FIG. 3 is a chart showing tensile index (Newton (N)-meters (m) per gram) versus pulp freeness (milliliters) for a medium consistency refining process 40, a low consistency refining process 42, and a high consistency refining process 44. The starting pulp for each of these processes is a Sitka spruce/Lodgepole pine softwood TMP (119 mL) produced using high consistency refining and treated with a 2% application of sodium sulfite ($Na_2SO_3$). The same type of refiner, an Andritz Model TwinFlo IIIB (20 inch diameter) pump-through refiner, was used for the low and medium consistency refiner processes 40, 42. Each of these processes was produced using five passes of refining in series. In the medium consistency process 40, the pulp consistency at the MC refiner was 7.8%. In the low consistency refining process 42, the pulp consistency at the LC refiner was 4.4%. In the high consistency refining process 44, the pulp consistency at the HC refiner was 24%. An Andritz Model 401 Atmospheric double disc refiner (36 inch diameter) was used to refine the TMP pulp at high consistency.

The MC refining 40 produced a steady increase in tensile index (pulp bonding strength) whereas the tensile index of the low consistency refiner series 44 dropped off dramatically when refined below a freeness of 40 mL. These results suggest that after several passes of refining at low consistency the pulp suspension is too fine to maintain a stable plate gap, resulting in excessive fiber cutting and loss in pulp strength. The medium consistency process 40 attained a comparable tensile index to the pulp produced by the high consistency process at lower freeness levels. These results demonstrated that medium consistency refining in a pump-through refiner can achieve bonding strength levels similar to that of more energy-intensive high consistency refined (HCR) pulps.

Figure 4:
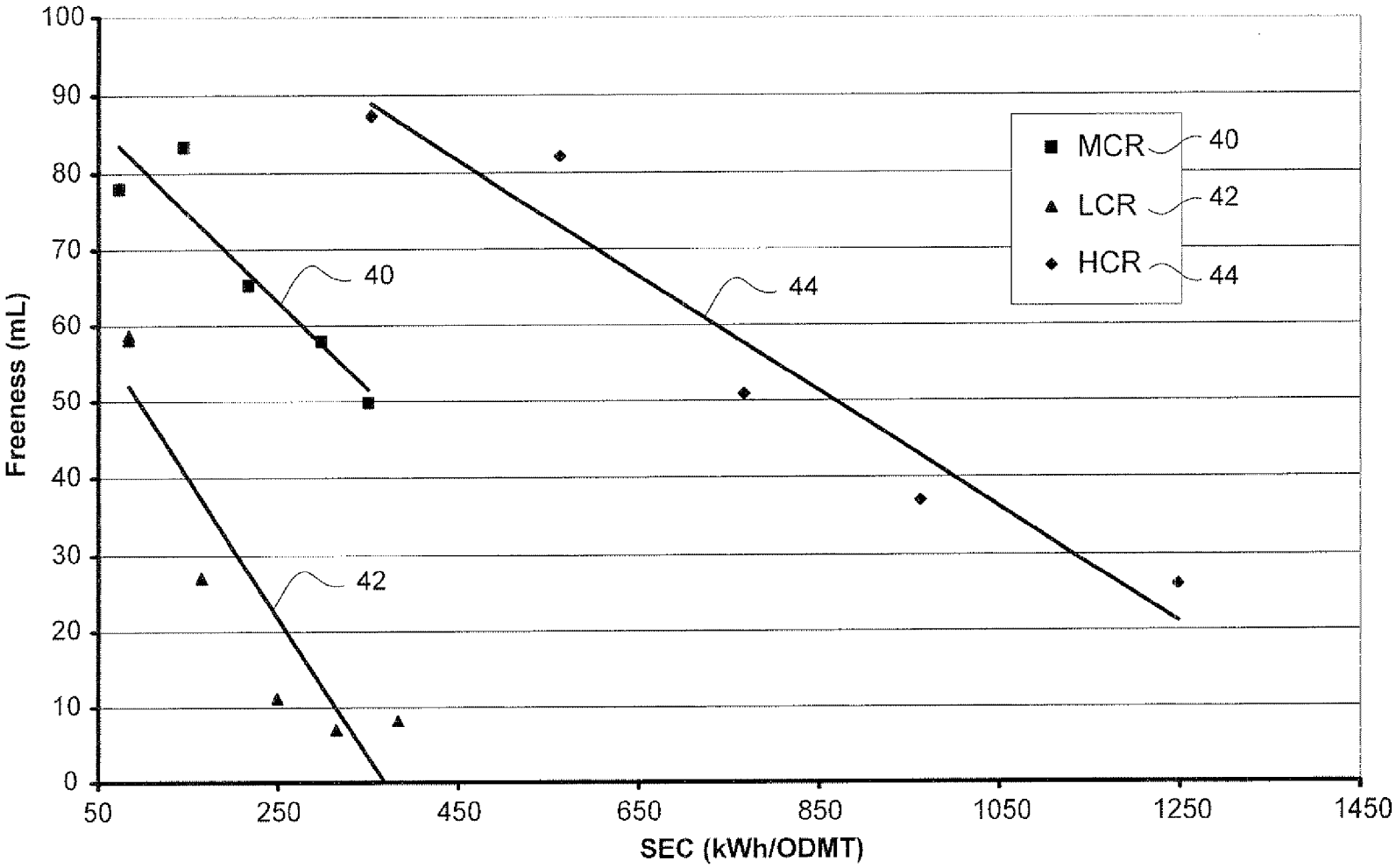
FIG. 4 is a chart showing freeness versus specific energy consumption for softwood fibers treated by medium consistency (MC), low consistency (LC) and high consistency (HC) refining techniques.

FIG. 4 presents the freeness (milliliters) for the above mentioned MCR 40, LCR 42 and HCR 44 series processes versus specific energy consumption (kilowatt (kW)-hours (hr) per ton). The specific energy consumption (SEC) reported on the horizontal axis includes the energy applied during each of the three refining processes but not the energy applied to the original TMP pulp. The specific energy consumption of the MCR series 40 is between that of the LCR series 42 and HCR series 44. At a freeness of 50 mL, the specific energy consumption of the LCR, MCR and HCR series are 95, 363 and 867 kilowatt (kW)-hours (hrs) per ton, respectively. The energy consumption for MCR 40 is almost 60% less than that obtained with HCR 44. The respective tensile index values for the LCR, MCR and HCR processes at a freeness of 50 mL are 49.3, 53.5, and 54.4 (Newton (N)-meters (m) per gram). The MCR series achieved a comparable tensile index to the HCR series while using 504 kilowatt (kW)-hours (hr) per ton less energy consumption.

Figure 5:
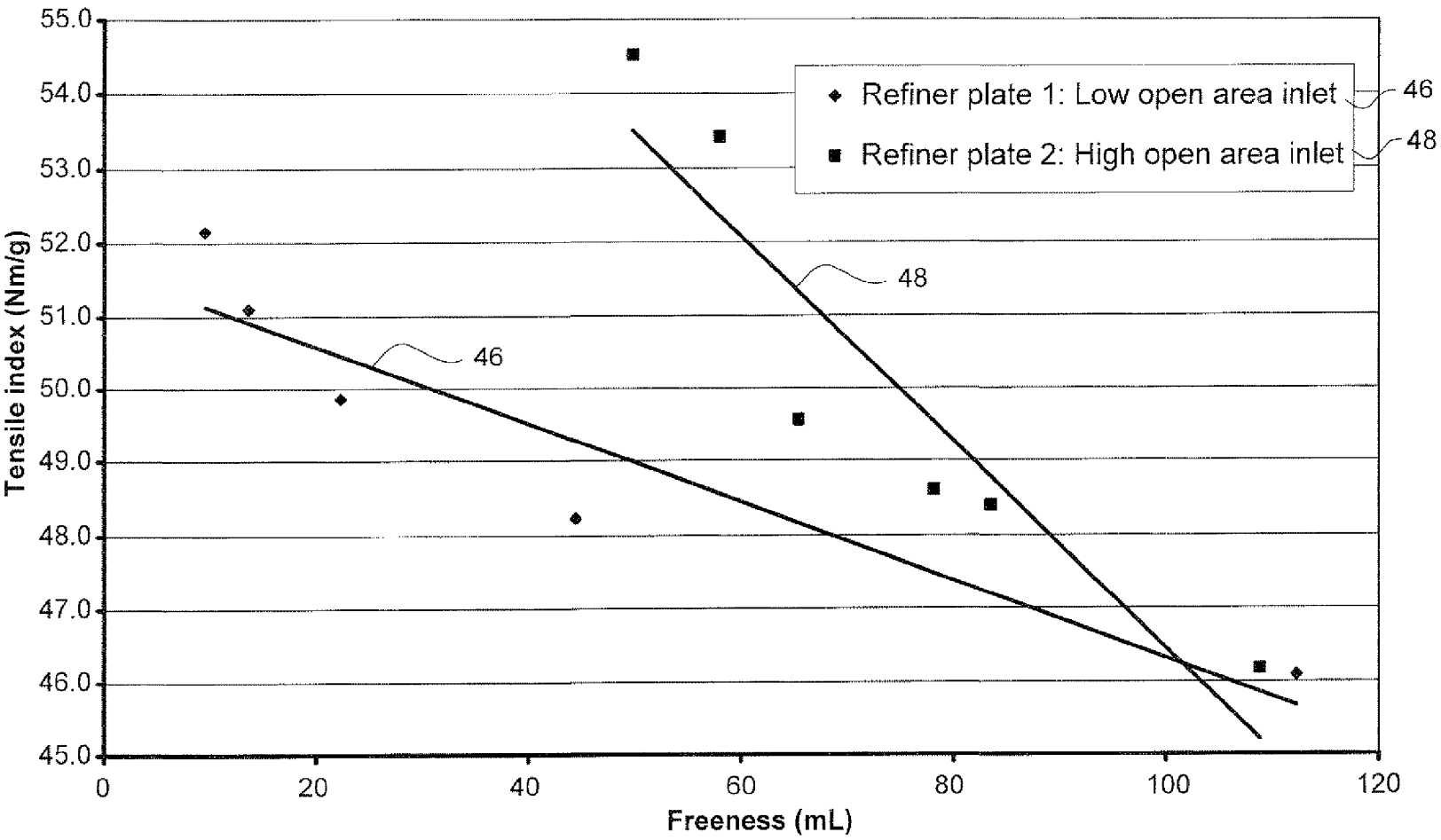
FIG. 5 is a chart showing fiber tensile index versus pulp freeness for softwood fibers treated by medium consistency refining using two different refiner plate designs.

FIG. 5 is a chart showing tensile index (Newton (N)-meters (m) per gram) versus pulp freeness (milliliters) for two medium consistency refining processes, 46 and 48. The starting pulp (before MC refining) is a Sitka spruce and Lodgepole pine softwood TMP (119 mL) produced using high consistency refining and treated with a 2% application of sodium sulfite ($Na_2SO_3$). An Andritz Model TwinFlo IIIB (20 inch diameter) pump-through refiner was used for both the medium consistency runs. Each of the series 46, 48 was produced with five passes of refining in series. In the two medium consistency processes 46, 48, the pulp consistency at the MC refiner was 7.1 percent (%) 46 and 7.8% 48, respectively. In the first MC process 46, the 7.1% MC pulp was refined using refiner plates having less open area in the inlet as compared to the plates used in the other 7.8% MC process 48. The refiner plates having a more open inlet and better feeding ability produced pulp having a higher tensile index for freeness levels above 100. The plate 40, shown in FIGS. 2A and 2B was used in the second series 48. Both series were refined at a similar refining intensity (specific edge load), approximately 0.31 to 0.37 Watt-seconds per meter. FIG. 5 shows that MC pulp 40 produced using the more open inlet refiner plates resulted in a higher and more desirable tensile index as compared to the other MC refining process 42 with the more restrictive inlet plates. The difference in tensile index further increases when the pulps are refined to lower freeness levels. The results suggest that a stable feeding open area is desirable when pumping thicker medium consistency pulp through a refiner.

Figure 6:
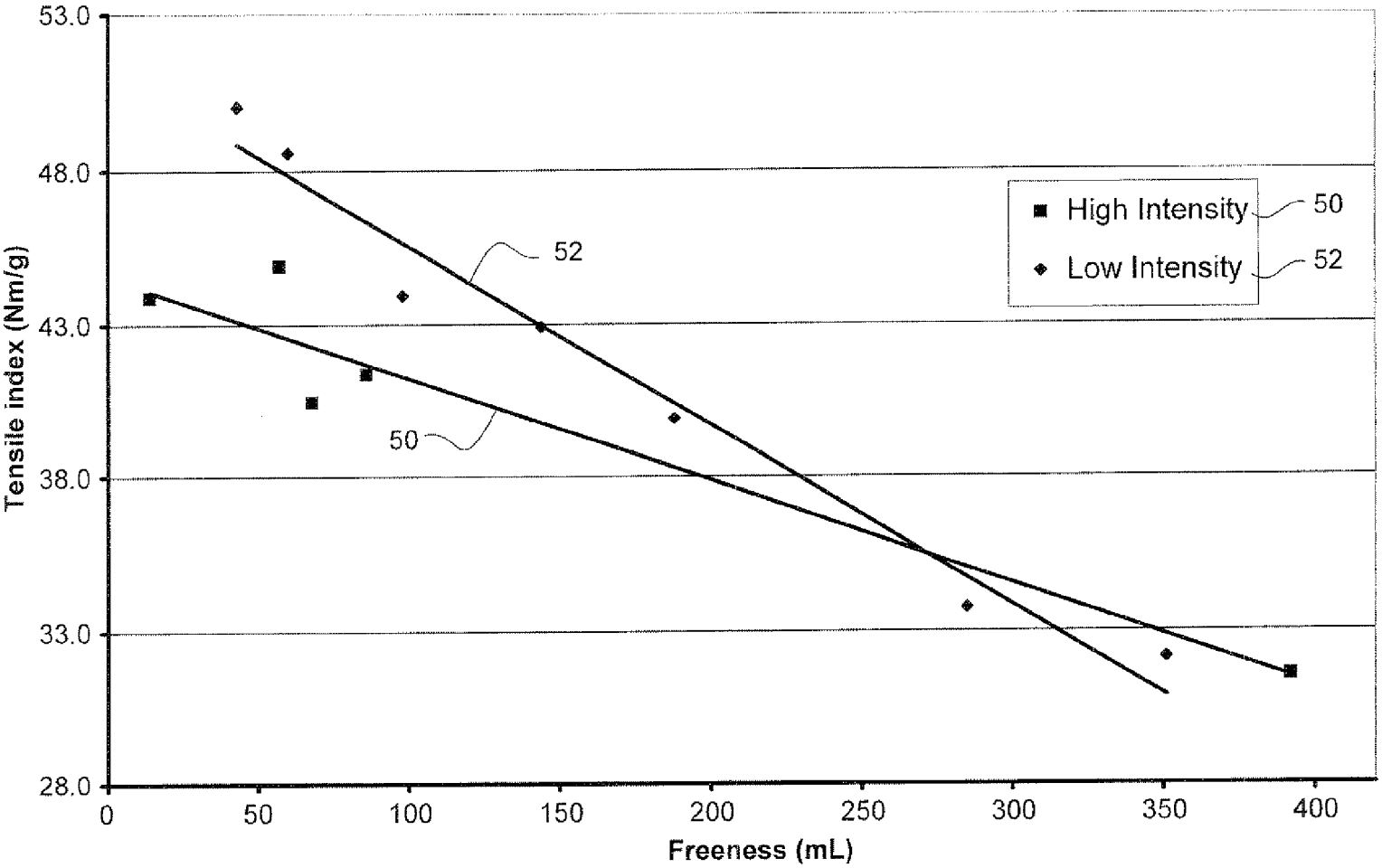
FIG. 6 is a chart showing tensile index versus pulp freeness for medium consistency refined TMP pulps produced using a low and high refining intensity.

FIG. 6 is a chart showing tensile index (Newton (N)-meters (m) per gram) versus pulp freeness (milliliters) for two medium consistency refining processes produced in multiple stages at high and low refining intensity, 50 and 52, respectively. The starting pulp (before MC refining) is a black spruce TMP produced using high consistency refining to a freeness of 472 mL. A Model TwinFlo IIIB (20 inch diameter) pump-through refiner was used to produce both series. The high intensity series 50 was refined at 6.9% consistency in multiple stages with an average refining intensity of 0.42 Watt (W) seconds (s) per meter. The low intensity series 52 was refined at 7.1% consistency in multiple stages with an average refining intensity of 0.31 Watt (W)·seconds (s) per meter. The medium consistency refiner series produced at lower refining intensity 52 resulted in a higher development of pulp tensile index compared to the series produced at higher refining intensity 50.

Figure 7:
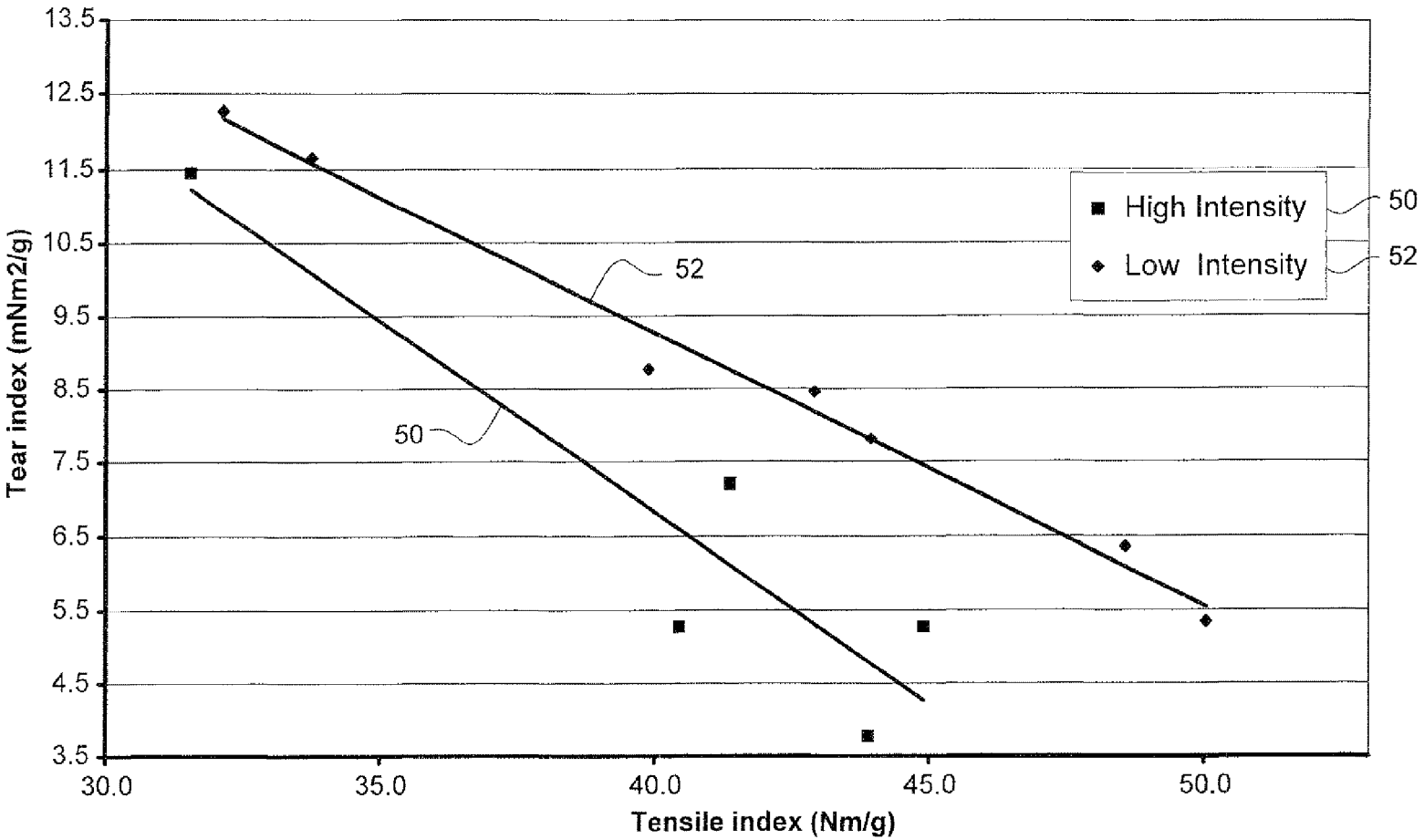
FIG. 7 is a chart showing tear index versus tensile index for medium consistency refined TMP pulps produced using a low intensity and a high refining intensity.

FIG. 7 is a chart showing tear index (Newton (N)-meters (m) per gram) versus pulp tensile index (Newton (N)-meters (m) per gram) for the same two medium consistency refining processes as described in FIG. 6. FIG. 7 shows that the medium consistency refined pulp produced at lower refining intensity 52 resulted in a higher development of pulp tear index at a given tensile index compared to the pulp refined at high intensity 50. As is observed with HCR and LCR, the results indicate the importance of operating conditions such as refining intensity (specific edge load) for optimizing pulp strength properties during MCR of mechanical pulps.

Figure 8:
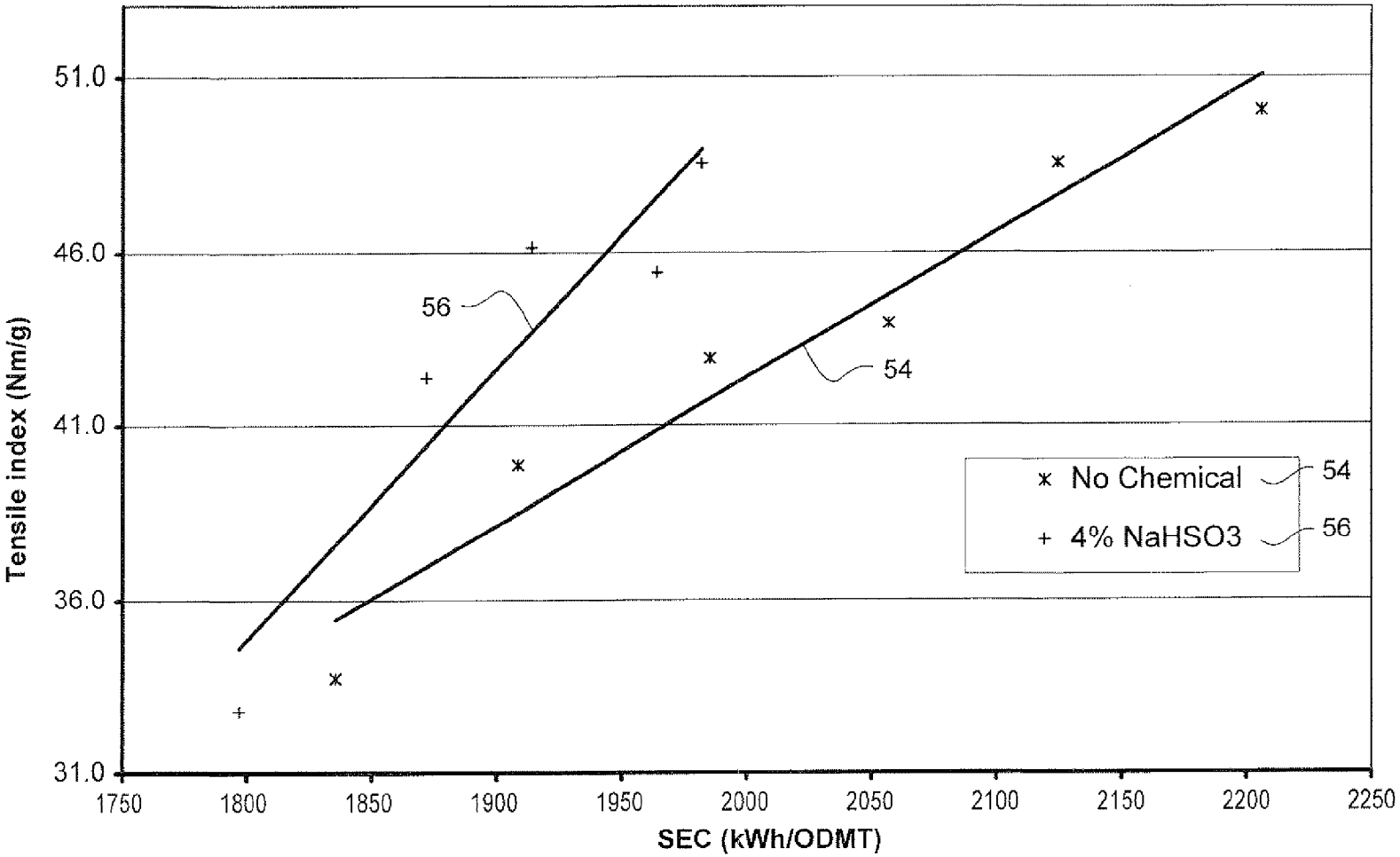
FIG. 8 is a chart showing tensile index versus specific energy consumption (SEC) for medium consistency refined TMP pulps produced with and without a chemical bisulfite pretreatment.

FIG. 8 is a chart showing tensile index (Newton (N)-meters (m) per gram) versus specific energy consumption (kilowatt (kW)-hours (hr) per ton) for two medium consistency refining processes produced with 56 and without 54 a chemical treatment prior to refining. The series produced with chemical treatment 56 was refined at 8.1% consistency and had a 4% application of sodium bisulfite on oven dry pulp fiber in the standpipe prior to refining. The series produced without chemical treatment was refined at a consistency of 7.1%. Both series were produced at a similar refining intensity, approximately 0.31 Watt (W) seconds(s) per meter. The starting pulp (before MC refining) was a black spruce TMP produced using high consistency refining to a freeness of 472 mL. A Model TwinFlo IIIB (20 inch diameter) pump-through refiner was used to produce both series. The medium consistency refiner series produced with bisulfite treatment 56 resulted in a higher development of pulp tensile index at a given application of specific energy. The application of chemical agents can be used to further improve the performance of medium consistency refining. In this case bisulfite addition improved the pulp strength development of a high freeness TMP pulp.

Figure 9:
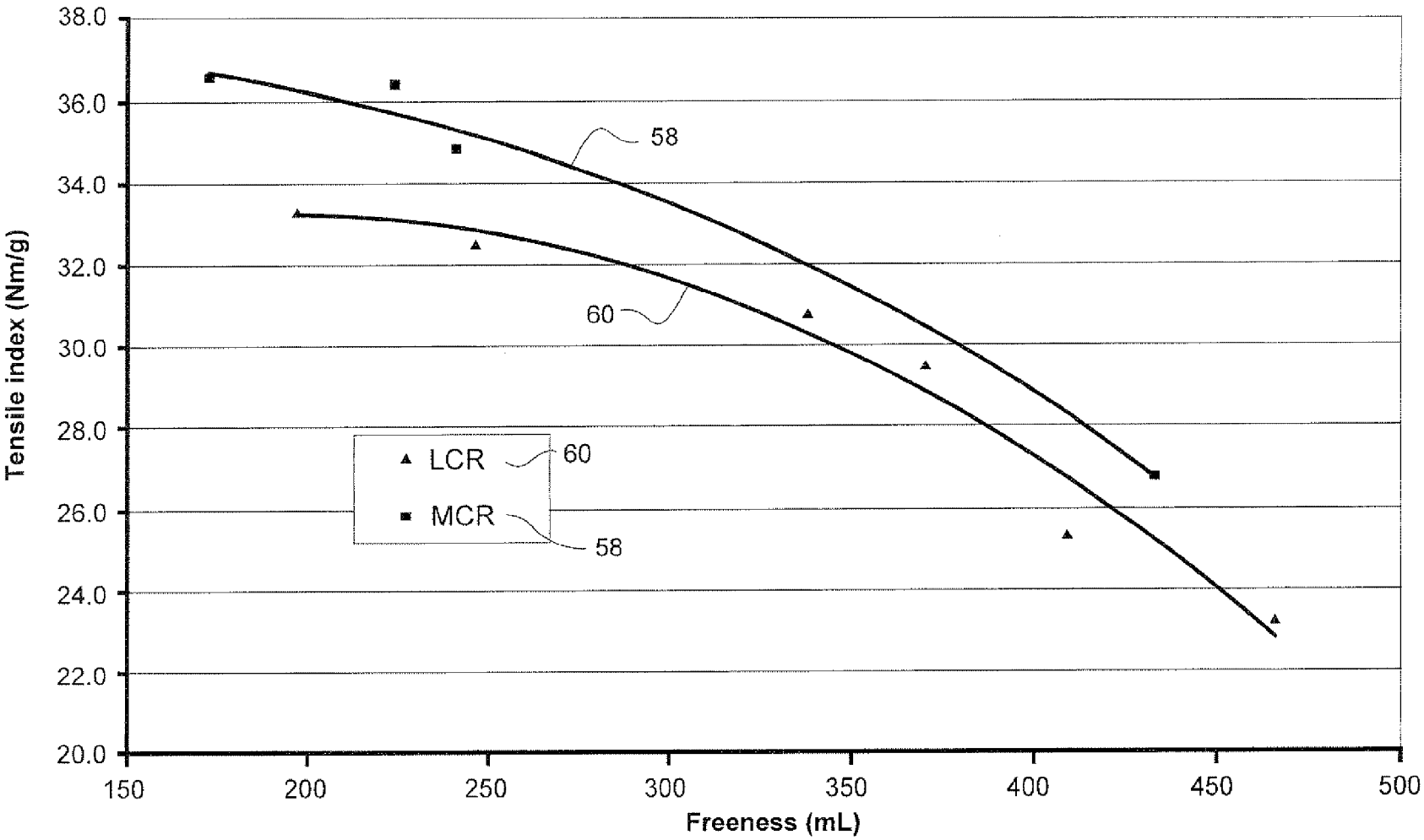
FIG. 9 is a chart showing tensile index versus pulp freeness for chemically treated hardwood fibers treated by medium consistency (MC) and low consistency (LC) refining techniques.

FIG. 9 is a chart showing tensile index (Newton (N)-meters (m) per gram) versus pulp freeness (milliliters) for a medium consistency refining process 58, and a low consistency refining process 60. The starting pulp for each of these processes is a hardwood, eucalyptus dunnii, produced using a chemimechanical HCR refining process with alkaline peroxide chemicals. A total of 6.2% sodium hydroxide and 4.9% hydrogen peroxide chemicals were applied to the eucalyptus fibers. During the chemimechanical pulping step the hardwood fibers were refined to a high freeness, 624 mL, using a pressurized HC refiner. An Andritz Model TwinFlo IIIB (20 inch diameter) pump-through refiner was used for the low and medium consistency refiner processes 58, 60. Each of these processes was produced using two passes of refining in series. In the medium consistency process 58, the pulp consistency at the MC refiner was 7.7%. In the low consistency refining process 60, the pulp consistency at the LC refiner was 4.1%.

Both the MC refining 58 and LC refining 60 produced a steady increase in tensile index. The MCR process 58 attained a higher tensile index across all levels of freeness as compared to the LCR process 60. These results suggest that medium consistency refining better develops the chemically treated hardwood fibers. It is postulated that the higher mass of fibers between the plates during MC refining results in more fiber to fiber development whereas LC refining has relatively more shearing actions.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

We claim:

1. A thermomechanical pulping method comprising:

refining wood chips, pre-conditioned wood fibers or other comminuted cellulosic materials to a refined pulp with a high consistency refining stage, diluting the refined pulp discharged by the high consistency refining stage in a standpipe and fluidizing the refined pulp in the standpipe using a fluidizer device positioned in the standpipe, such that the refined pulp remains in a fluidized state while in the standpipe, feeding the fluidized refined pulp to a medium consistency refining stage, wherein the fluidized refined pulp is fluidized before entering the medium consistency refining stage and the fluidizer device is separate from the medium consistency refining stage, and refining the fluidized refined pulp in the medium consistency refining stage.

2. The method of claim 1 wherein the high consistency refining stage includes refining the wood chips, the pre-conditioned wood fibers or the other comminuted cellulosic materials with a pressurized high consistency refiner.

3. The method of claim 1 further comprising at least one of: treating the wood chips, the pre-conditioned wood fibers or the other comminuted cellulosic materials by pressurized chip destructuring in a chip press and gentle defibration in a fiberizing refiner before the high consistency refining stage.

4. The method of claim 3 wherein pretreatment chemicals are added at a discharge of one of a chip press discharge, fiberizer refiner and the high consistency refining stage.

5. The method as in claim 1 wherein the high consistency refining stage includes refining the wood chips, the pre-conditioned wood fibers or the other comminuted cellulosic materials in a high intensity primary refiner.

6. The method as in claim 1 further comprising chemically treating the wood chips, the pre-conditioned wood fibers or the other comminuted cellulosic materials prior to or in the high consistency refining stage.

7. The method as in claim 1 wherein the medium consistency refining stage includes a mechanical disc refiner having plate segments with an open inlet.

8. The thermomechanical pulping method of claim 1 wherein feeding the fluidized refined pulp includes pumping the fluidized refined pulp through a medium consistency refiner included in the medium consistency refining stage.

9. A thermomechanical pulping method comprising:

refining wood chips, pre-conditioned wood fibers or other comminuted cellulosic materials to a refined pulp in a high consistency refining stage, wherein the refined pulp is in a suspension at a discharge of the high consistency refining stage and the suspension has a pulp consistency of at least twenty percent (20%) by weight of the suspension;

diluting the suspension of refined pulp discharged from the high consistency refining stage to a medium consistency having a pulp consistency in a range of 5% to 14% of consistency by weight, wherein the dilution step is performed in a standpipe having a conditioner in a lower region of the stand pipe, wherein the conditioner maintains the pulp in the standpipe in a fluidized state;

discharging the diluted and fluidized refined pulp from the lower region of the standpipe to a medium consistency refining stage, wherein the fluidized refined pulp is fluidized before entering the medium consistency refining stage and the conditioner is separate from the medium consistency refining stage, and refining the diluted and fluidized refined pulp in the medium consistency suspension from the dilution step using the medium consistency refining stage.

10. The method as in claim 9 further comprising preconditioning treatments applied to the high consistency pulp suspension prior to refining the pulp, wherein the preconditioning treatments enhance pulp in the high consistency refining stage.

11. A thermomechanical pulping method comprising:

refining wood chips, pre-conditioned wood fibers or other comminuted cellulosic materials to a refined pulp with a high consistency refining stage, diluting the refined pulp discharged by the high consistency refining stage in a standpipe and fluidizing the refined pulp in the standpipe using a fluidizer device positioned in the standpipe, such that the refined pulp remains in a fluidized state while in the standpipe, feeding the fluidized refined pulp to medium consistency refining stage including a medium consistency pump and a medium consistency refiner, wherein the fluidized refined pulp is fluidized before entering the medium consistency pump and the fluidizer device is separate from the medium consistency pump, and refining the fluidized refined pulp in the medium consistency refining stage, wherein the fluidized refined pulp flows through the medium consistency pump and into the medium consistency refiner.

12. A thermomechanical pulping method comprising:

refining wood chips, pre-conditioned wood fibers or other comminuted cellulosic materials to a refined pulp in a high consistency refining stage, wherein the refined pulp is in a suspension at a discharge of the high consistency refining stage and the suspension has a pulp consistency of at least twenty percent (20%) by weight of the suspension;

diluting the suspension of refined pulp discharged from the high consistency refining stage to a medium consistency having a pulp consistency in a range of 5% to 14% of consistency by weight, wherein the dilution step is performed in a standpipe having a conditioner in a lower region of the stand pipe, wherein the conditioner maintains the pulp in the standpipe in a fluidized state;

discharging the diluted and fluidized refined pulp from the lower region of the standpipe to a medium consistency refining stage including a medium consistency pump and a medium consistency refiner, wherein the fluidized refined pulp is fluidized before entering the medium consistency pump and the conditioner is separate from the medium consistency pump, and refining the diluted and fluidized refined pulp, outputted from the medium consistency pump, in the medium consistency refiner.

* * * * *